US006932168B2

(12) United States Patent
Morgan et al.

(10) Patent No.: US 6,932,168 B2
(45) Date of Patent: Aug. 23, 2005

(54) METHOD FOR MAKING A WELL FOR REMOVING FLUID FROM A DESIRED SUBTERRANEAN FORMATION

(75) Inventors: Claude Morgan, Bluefield, WV (US); Geoff W. Fanning, Fairmont, WV (US); Joseph P. Aman, McMurray, PA (US); Brian Varcoe, Katy, TX (US); Robert Kolkmeier, Needville, TX (US); Robert Stayton, The Woodlands, TX (US); Richard L. Toothman, Bluefield, VA (US)

(73) Assignee: CNX Gas Company, LLC, North Tazewell, VA (US)

( * ) Notice: Subject to any disclaimer, the term of this patent is extended or adjusted under 35 U.S.C. 154(b) by 260 days.

(21) Appl. No.: 10/438,720

(22) Filed: May 15, 2003

(65) Prior Publication Data

US 2004/0226719 A1 Nov. 18, 2004

(51) Int. Cl.[7] ..... E21B 43/00
(52) U.S. Cl. ..... 175/62; 166/52; 166/245
(58) Field of Search ..... 166/50, 52, 245, 166/263; 175/61, 62, 69

(56) References Cited

U.S. PATENT DOCUMENTS

| | | | | |
|---|---|---|---|---|
| 3,285,350 A | | 11/1966 | Henderson | |
| 3,386,508 A | | 6/1968 | Bielstein et al. | |
| 3,934,649 A | | 1/1976 | Pasini, III et al. | |
| 4,305,464 A | | 12/1981 | Masszi | |
| 4,344,485 A | | 8/1982 | Butler | |
| 4,390,067 A | | 6/1983 | Willman | |
| 4,458,767 A | | 7/1984 | Hoehn, Jr. | |
| 4,573,541 A | | 3/1986 | Josse et al. | |
| 4,605,076 A | | 8/1986 | Goodhart | |
| 4,646,836 A | | 3/1987 | Goodhart | |
| 4,753,485 A | | 6/1988 | Goodhart | |
| 4,957,172 A | | 9/1990 | Patton et al. | |
| 5,074,360 A | | 12/1991 | Guinn | |
| 5,103,920 A | | 4/1992 | Patton | |
| 5,217,076 A | | 6/1993 | Masek | |
| 5,402,851 A | | 4/1995 | Baiton | |
| 5,450,902 A | * | 9/1995 | Matthews | 166/268 |
| 5,655,605 A | * | 8/1997 | Matthews | 166/370 |
| 5,785,133 A | | 7/1998 | Murray | |
| 5,863,283 A | | 1/1999 | Gardes | |

(Continued)

FOREIGN PATENT DOCUMENTS

| | | |
|---|---|---|
| WO | 00/31376 | 6/2000 |
| WO | 02/059455 | 8/2002 |
| WO | 02/061238 | 8/2002 |
| WO | 03/038233 | 5/2003 |

OTHER PUBLICATIONS

Gardes Energy Services, Inc., A New Direction in Coalbed Methane and Shale Gas Recovery (Do not know date of publication, received with letter dated Jan. 13, 2003).

*Primary Examiner*—Frank Tsay
(74) *Attorney, Agent, or Firm*—Paul A. Beck & Associates, P.C.

(57) ABSTRACT

An improved method for making a well for removing fluid from a desired subterranean formation. This invention provides for a method for making a well for removing fluid from a desired subterranean formation having an interface zone. The interface zone is coupled to a main directional well bore that extends from a top surface at ground level into the desired subterranean formation. A lateral well bore is also coupled to the interface zone. A directional sump bore is also coupled to the interface zone and the directional sump bore extends from the interface zone to a point below the interface zone. There is also a means for moving fluid from the directional sump bore through the main directional well bore to the top surface.

16 Claims, 9 Drawing Sheets

U.S. PATENT DOCUMENTS

| | | | | |
|---|---|---|---|---|
| 5,868,210 | A | | 2/1999 | Johnson et al. |
| 6,024,171 | A | | 2/2000 | Montgomery et al. |
| 6,279,658 | B1 | | 8/2001 | Donovan et al. |
| 6,280,000 | B1 | | 8/2001 | Zupanick |
| 6,315,044 | B1 | | 11/2001 | Tinker |
| 6,425,448 | B1 | | 7/2002 | Zupanick |
| 6,439,320 | B2 | | 8/2002 | Zupanick |
| 6,454,000 | B1 | | 9/2002 | Zupanick |
| 6,478,085 | B2 | | 11/2002 | Zupanick |
| 6,561,288 | B2 | | 5/2003 | Zupanick |
| 6,598,686 | B1 | | 7/2003 | Zupanick |
| RE38,636 | E | * | 10/2004 | Gondouin ..... 166/380 |
| 2002/0096336 | A1 | | 7/2002 | Zupanick |
| 2002/0148605 | A1 | | 10/2002 | Zupanick |
| 2002/0148613 | A1 | | 10/2002 | Zupanick |
| 2002/0148647 | A1 | | 10/2002 | Zupanick |

* cited by examiner

METHOD FOR MAKING A WELL FOR REMOVING FLUID FROM A DESIRED SUBTERRANEAN FORMATION

BACKGROUND OF THE INVENTION

1. Field of the Invention

This invention relates generally to removing fluid from a subterranean formation and more particularly to a method for making a well for removing fluid from a desired subterranean formation.

2. Background of the Invention

Subterranean formations often contain desirable fluids that can be used for many applications. Therefore there is need to remove the desirable fluids from the subterranean formation. The subterranean formations often extend horizontally over many thousands of feet and are often very shallow in depth.

One prior art method used to remove desired fluids from a subterranean formation is drilling a horizontal well. The horizontal portion of the well may extend over a significant length of the subterranean formation. When the horizontal portion of the well extends over a significant length of the subterranean formation it intersects multiple natural fractures within the subterranean formation. The natural fractures provide a pathway for fluids to migrate to the well bore.

However, the subterranean formation often contains other fluids beside the desirable fluids that need to be removed before the desirable fluid can be removed. In prior art methods that only use a horizontal well having only a substantially vertical section, curved section and a horizontal section it is difficult to remove the other fluid and thus makes the horizontal well inefficient for removing the desired fluid.

Another prior art method used to remove the desirable fluid from the subterranean formation is drilling a vertical well. However, vertical wells only drain a small amount of desired fluid around the radius of the vertical well because it only intersects a few natural fractures within the subterranean formation without any external stimulation. Thus the vertical well can be inefficient for removing desirable fluid from the subterranean formation.

In prior art methods using a vertical well or a horizontal well it is desirable to use underbalanced drilling. Drilling fluid is often used during the drilling operations. The drilling fluid can be used to remove drilling shavings or cuttings and force them to the surface through circulation of the fluids. If the hydrostatic pressure created by the drilling process exceeds the natural pressure of the subterranean formation the drilling shavings or cuttings may be forced into the formation.

Another method previously used to remove desirable fluids is described in U.S. Pat. No. 6,280,000 issued to Zupanick. This method uses both a horizontal well and a vertical well that intersect each other. This method solves some of the problems of the prior art. However this method requires two wells that can be inefficient and expensive. This method requires a larger well pad site to accommodate both the vertical well and the horizontal well. In addition it is difficult and costly to intersect a vertical well and a horizontal well. This method may require a cavity to be excavated at the bottom of the vertical well that can add additional cost.

SUMMARY OF THE INVENTION

The object of this invention is to provide a method for making a well for removing fluid from a desired subterranean formation that does not have the disadvantages of the prior art.

This invention provides for a method for making a well for removing fluid from a desired subterranean formation having an interface zone. The interface zone is coupled to a main directional well bore that extends from a top surface at ground level into the desired subterranean formation. A lateral well bore is also coupled to the interface zone. A directional sump bore is also coupled to the interface zone and the directional sump bore extends from the interface zone to a point below the interface zone. There is also a means for moving fluid from the directional sump bore through the main directional well bore to the top surface.

The interface zone can be within the subterranean formation. The main directional well bore can have an intermediate casing. A slotted production liner that has a diameter that is smaller than a diameter of the intermediate casing and has a hanging assembly at a top end of the liner so that the liner can be inserted into the intermediate casing and is secured to the bottom of the intermediate casing and the slotted production liner extends into the directional sump bore.

Alternatively the intermediate casing can extend from the top surface through the main directional well bore into the directional sump bore. The intermediate casing can have a window located in the interface zone.

This invention also provides for a method for removing fluid from a desired subterranean formation having a main directional well bore that extends from a top surface at ground level into the desired subterranean formation. An intermediate casing having an attached external parasite tube that extends from the top surface to a point of intersection with the intermediate casing. Air pressure can be inserted down the parasite tube. Drilling fluid can be inserted down a drill string within the intermediate casing to create hydrostatic pressure less than a desired subterranean zone breakdown pressure which provides an underbalanced drilling environment and facilitates the removal of cuttings and drilling fluid to be circulated to the top surface at ground level through the intermediate casing. An interface zone that is coupled to the main directional well bore is drilled using the underbalanced drilling environment. A lateral well bore that is coupled to the interface zone is drilled using the underbalanced drilling environment. A directional sump bore that is coupled to the interface zone is drilled using the underbalanced drilling environment. The directional sump bore extends from the interface zone to a point below the interface zone. A means for moving fluid from the directional sump bore is used to move fluid from the directional sump bore through the main directional well bore to the top surface.

This invention also can include drilling the lateral well bore prior to drilling the directional sump bore.

The method of this invention can also include drilling wherein the desired subterranean formation is a coal seam.

BRIEF DESCRIPTION OF THE DRAWINGS

The Figures referred to in the following embodiments are not to scale and are intended as illustrative representations of the described method for making a well for removing fluid from a desired subterranean formation.

DETAILED DESCRIPTION OF THE PREFERRED EMBODIMENT

Definitions

Figure 1:
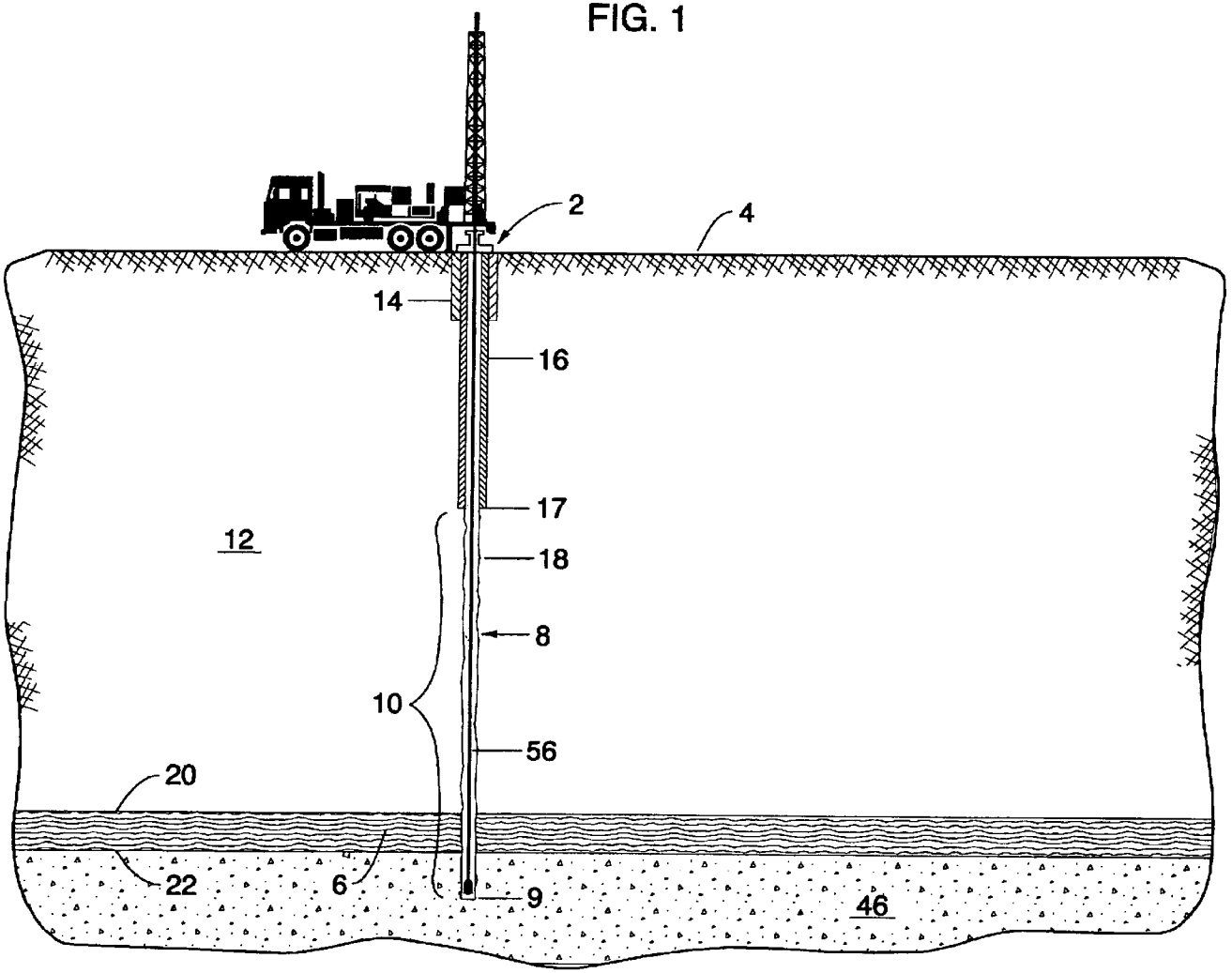
FIG. 1 illustrates a cross-sectional view of a substantially vertical well bore penetrating through and extending below a desired subterranean formation.

"Well" means an orifice in the ground made by drilling, boring or any other means, from which fluids such as water, oil and gas are recovered or that was made for the purpose of recovering such fluids. A well may also provide a means for injecting fluids into a subterranean formation. A well is drilled from a surface elevation to a desired subterranean formation(s) providing a conduit for injecting fluids and/or removing fluids from the formation(s).

"Fluid" means all liquids and gases including but not limited to water, brine, chemically entrained liquids, foam, air, nitrogen or hydrocarbons injected into and/or removed from a well.

"Interface Zone" means a zone within a desired subterranean formation where: a) a main directional well bore, b) a lateral well bore and c) a directional sump bore all interconnect.

"Main Directional Well Bore" means a well bore comprised of a substantially vertical section and a substantially curved section drilled from a top surface and terminating at the interface zone.

"Top Surface" means the topographic location on the Earth's surface that has been constructed at a designed elevation for the purpose of drilling a well and accommodates any associated support facilities and equipment needed during the drilling process.

"Desired Subterranean Formation" means a geologic stratum or strata targeted for recovery of hydrocarbons. These geologic strata include but are not limited to coal seams, carbonaceous shales, silicious shales, sandstone, chalk or any target formation containing hydrocarbons.

"Coupled" means the various defined well bores (main directional, lateral and directional sump) are connected and join at the interface zone.

"Lateral Well Bore" means the substantially horizontal section of a well bore that extends from the interface zone into the desired subterranean formation and is drilled to a designed length substantially within the limits of the desired subterranean formation.

"Directional Sump Bore" means the substantially declined section of the well bore that extends from the interface zone a designed distance below the interface zone for the purpose of collecting fluids and/or solids entrained in the fluids for removal of same to the top surface.

"Point Below the Interface Zone" means an elevation (typically referenced to sea level in feet or meters) that is less than the elevation of the interface zone. The terminus (bottom) of the directional sump bore is designed to have a lower elevation than the elevation of the interface zone, thereby permitting fluids to flow from the lateral well bore into the directional sump bore.

"Means for Moving Fluid" means any apparatus or method for removing fluids from a well including but not limited to mechanical or electric drive pumps, gas lift systems and natural reservoir pressure methods.

"Intermediate Casing" means an appropriately sized and designed well bore casing that extends from the top surface through the main directional well bore and terminates at a designed elevation or point within the main directional well bore, interface zone or sump bore The casing protects the integrity of the borehole and provides a conduit for removing fluids from the well.

"Slotted Production Liner" means a well bore liner designed to: a) permit the flow of fluids through a set of pre-cut slots in a section of the liner and b) protect the well bore from collapse of the surrounding strata. The slotted production liner extends from the terminus of the intermediate casing (secured to the casing with a hanger assembly) through the interface zone and into the upper section of the directional sump bore. The slotted portion of the liner permits fluids from the desired subterranean formation to flow from the lateral well bore through the slots into the sump bore and/or up through the fluid removal system. The slotted production liner is comprised of an upper section that is perforated (slots) and a lower section that is solid casing without perforations.

"Hanging Assembly" means a packer hanger assembly is attached to the slotted production liner and inserted within the Intermediate casing. The hanger and slotted production liner are lowered to a point near the bottom end of the intermediate casing. The packer hanger is engaged and secures the slotted production liner to the inside circumference of the intermediate casing.

"Intermediate Casing Window" means a well bore casing that has an opening pre-milled along a section of its longitudinal axis designed to: a) permit a directional drilling assembly and drill steel (or coiled tubing) to pass through the opening in the casing (window) and enter the desired subterranean formation to drill the lateral well bore, b) allow fluids to flow from the lateral well bore through the opening (window) into the directional sump bore and/or out through the fluid removal system and c) to protect the well bore from collapse of the surrounding strata. The window casing is the same diameter as the intermediate casing and is connected to the intermediate casing at a flush joint coupling. The window section in the casing extends from the bottom end of the intermediate casing through the interface zone into the upper section of the directional sump bore. The window section of the casing is oriented and aligned to face the opening of the planned lateral well bore.

"External Parasite Tubing" means a section of suitable tubing material attached to the outer surface of the intermediate casing and extending from the top of the intermediate casing to a point near the bottom of the substantially vertical portion of the main directional well bore. The parasite tube is connected to the intermediate casing at an elbow joint that permits airflow into the interior of the intermediate casing. The parasite tube provides a conduit to supply compressed air (or other fluids) into the drilling process to increase aeration of the drilling fluid and reduce the hydrostatic pressure exerted on the desired subterranean formation.

"Drilling Fluid" means a drilling media (liquid or gas) typically injected through the drill string and used to remove drill cuttings from a well bore, lubricate the drill bit during the drilling process, power the motor assembly on directional drilling tools and in certain cases aid in the prevention of well blow-outs. A drilling fluid may include but is not limited to: water, water with various chemical additives, special chemical fluids, air, nitrogen and various foam agents.

"Drill String" means generally, steel tubing with male and female ends comprised of 30 foot pipe lengths that are coupled together forming a length of drill string capable of drilling to the desired subterranean formation. In rotary drilling the drill string is used to rotate the bit and provide a conduit for circulating the drilling fluid. In directional drilling the drill string is coupled to a down-hole motor and drill bit assembly. The drill string provides a conduit for injecting fluids to propel the drill bit drive motor, a means for circulating drilling fluids and provides a mechanism for inserting and removing the drill bit assembly. The drill string does not rotate in directional drilling applications, other than to orient the bit, but instead slides along the well bore. Directioal drilling applications may also utilize a continuous coiled tubing (no pipe joints) that attaches to the downhole motor and drill bit assembly and performs the same general functions as the jointed drill pipe. The coiled tubing feeds continuously into the well bore from a specialized reel truck.

"Hydrostatic Pressure" means the pressure exerted by a column of fluid at rest. Pressure is typically measured in pounds per square inch (psi) and adjusted for atmospheric pressure by reporting gauge or absolute pressure (psig or psia).

"Subterranean Zone Breakdown Pressure" means the pressure exerted on a desired subterranean formation by a fluid column that is greater than the natural pressure inherent in the formation. The hydrostatic pressure may cause damage to the natural fractures and pores of the desired formation by forcing fluids and fine particles entrained in the fluids into the formation. Damage may be severe enough to prevent or limit hydrocarbon recovery.

"Underbalanced Drilling" means a method of drilling a desired subterranean formation whereby the hydrostatic pressure exerted by a column of drilling fluid in the well bore and/or drill string is less than the natural pressure inherent in the desired subterranean formation. Underbalanced drilling techniques are utilized to prevent damage to the desired subterranean formation and in particular low pressure formations. The introduction of air, nitrogen or other gases to the drilling fluids reduces the density of the co-mingled fluids and effectively decreases hydrostatic pressure. Other low density fluids such as chemical foams and air mist (compressed air and water) may be used as a drilling fluid to achieve an underbalanced condition. The underbalanced environment prevents damage to the formation and facilitates the removal of cuttings and drilling fluids that are circulated out through the annulus of the drill string and intermediate casing to a surface collection pit.

Description

The present invention represents an improvement to prior art as a method for removing fluids and recovering hydrocarbons from a desired subterranean formation 6. The present method incorporates a main directional well bore 26, a lateral well bore 32 and a directional sump bore 34 all coupled at an interface zone 36. Additional laterals may be side-tracked from the initial lateral well bore 32 to access a larger area of the desired subterranean formation 6. Produced fluids and hydrocarbons from the lateral well bore 32 or lateral well bore(s) flow to a directional sump bore 34 and are removed through the main directional well bore 26. The single well 2 has the capability to recover fluids and hydrocarbons from a large area using a single site location and one main well 2. This method has distinct economic advantages over multi-well recovery systems. Low pressure reservoirs commonly require the drainage of water from the desired subterranean formation 6 before the reservoir will release productive volumes of hydrocarbons. The method described herein incorporates a main directional well bore 26 that intercepts the desired subterranean formation 6 at a low angle approximately parallel with the plane of the desired subterranean formation 6. Drainage of water and other fluids from the desired subterranean formation 6 are channeled through a lateral well bore 32 that connects to the main directional well bore 26 and a directional sump bore 34 where the fluids collect in the directional sump bore 34 for removal by a pumping system. The low angle intercept of the desired subterranean formation 6 minimizes restrictions to the flow of fluids that are commonly gravity drained under low formation pressure through the lateral well bore 32 into the directional sump bore 34. The low angle intercept provides a more efficient and productive means of draining water and other fluids from the desired subterranean formation 6.

In FIG. 1 a well 2 is drilled from a top surface 4 through a series of overburden strata 12 and extends into and below the desired subterranean formation 6. The purpose of extending the vertical well bore 8 below the desired subterranean formation 6 is to ensure logging of the desired subterranean formation 6 accurately identifies the elevation of the desired subterranean formation top 20 and the desired subterranean formation bottom 22. Thickness and elevation data obtained from logging the desired subterranean formation 6 and the vertical well bore 8 is used to aid in the design of the main directional well bore 26, lateral well bore 32 and directional sump bore 34 (illustrated in FIG. 2, FIG. 3 and FIG. 4). The vertical well bore 8 may be lined with a conductor casing 14 and a surface casing 16. Both the conductor casing 14 and the surface casing 16 are cemented from the top surface 4 to the bottom of each respective casing. Although the referenced figures illustrate the use of casings in the well 2, the need for installation of casings will be dictated by the competency of the geologic strata and the presence of water producing zones intersected by the well 2.

After the substantially vertical well bore 8 is drilled to its designed depth the drill string 56 is removed from the well 2 and the hole is logged. The uncased open-hole section 10 of (shown in FIG. 1) vertical well bore 8 is cemented from the vertical well bore bottom 9 to an elevation near the surface casing bottom17 and above the designed kick-off point 18 (shown in FIG. 2). The cemented column is drilled from the bottom of the surface casing 17 to the kick-off point 18 to prepare the vertical well bore 8 for insertion of the directional drilling tools 38 (shown in FIG. 2). Once directional drilling begins, the portion of the vertical well bore 8 beginning at the top surface 4 and extending to the kick-off point 18 will be referred to as the vertical section 30 of the main directional well bore 26 illustrated in FIG. 2, FIG. 3 and FIG. 4.

Figure 2:
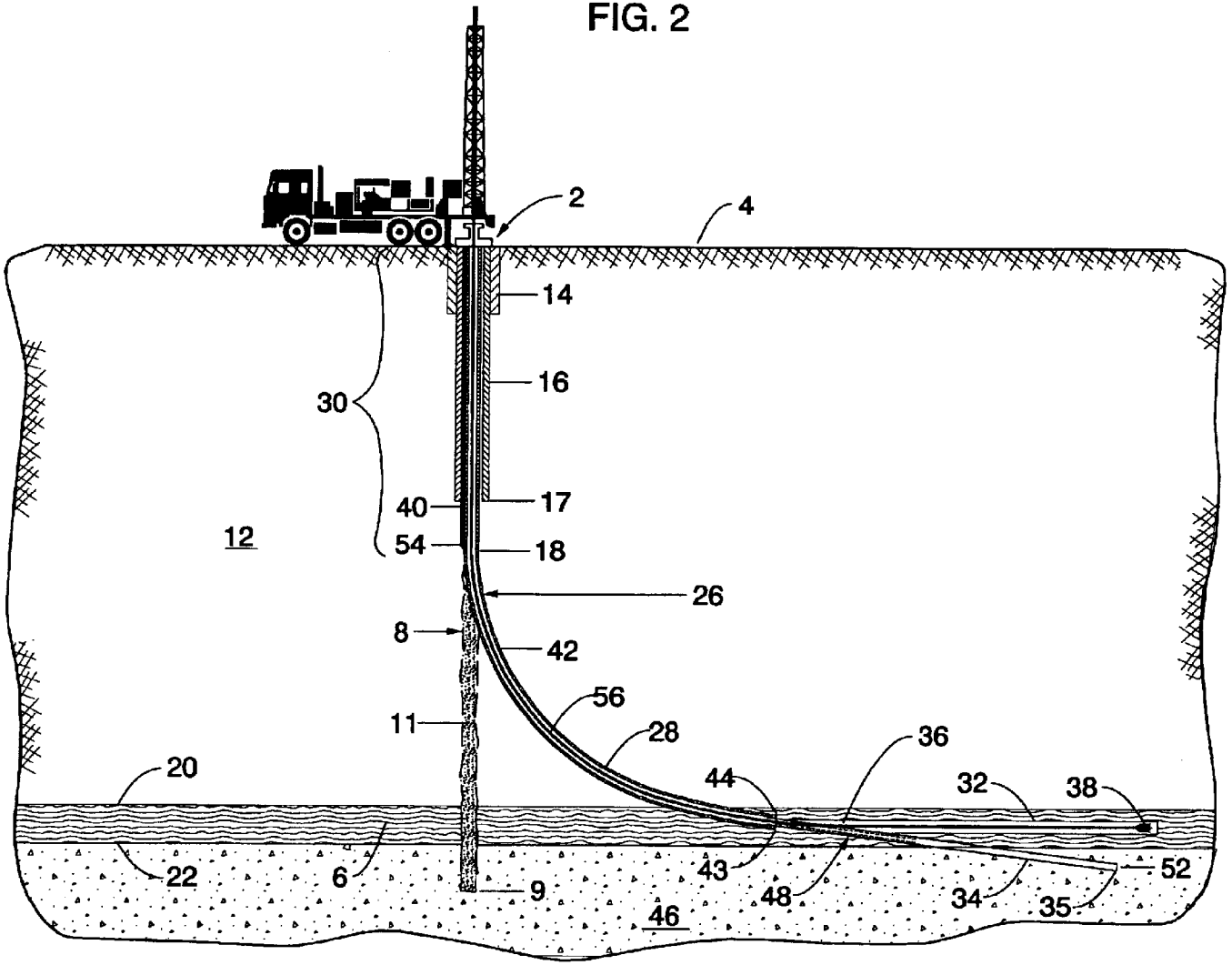
FIG. 2 illustrates a cross-sectional view of a well incorporating a main directional well bore (comprised of a substantially vertical section and a curved section), a lateral well bore and a directional sump bore for the purpose of removing fluids and recovering hydrocarbons from a subterranean formation.

FIG. 2 illustrates a well 2 comprised of a main directional well bore 26, a lateral well bore 32 and a directional sump bore 34. The main directional well bore 26 consists of two primary sections, a substantially vertical section 30 and a curved section 28 that terminates at the interface zone 36. The interface zone 36 is located within the desired subterranean formation 6 and identifies the area or zone where the main directional well bore 26 is coupled with the lateral well bore 32 and the directional sump bore 34.

Constructing the well 2 incorporates several drilling techniques and a variety of specialized drilling tools well known to those skilled in the art. The substantially vertical section 30 of the main directional well bore 26 can be drilled using conventional rotary drilling methods and tools. Drilling the curved section 28 of the main directional well bore 26, the lateral well bore 32 and directional sump bore 34 requires a specialized set of drilling tools 38 that incorporates a bit, downhole motor and a measurement-while-drilling (MWD) system. The specialized build assemblies (directional drilling apparatus) adjust for changes in inclination and azimuth to orient and steer the bit during drilling of the curved section 28, the lateral well bore 32 and directional sump bore 34.

Once the cemented column 11 has been re-drilled from the surface casing bottom 17 to the kick-off point 18, directional drilling of the curved section 28 of the main directional well bore 26 is initiated. The curved section 28 is designed to terminate within the desired subterranean formation 6 at the interface zone 36. The radius of the curved section 28 will be designed to a minimum curvature as required to accommodate an intermediate casing 42. The terminus 44 of the curved section 28 of the main directional well bore 26 will be oriented approximately parallel to the desired subterranean formation 6 at the interface zone 36. After completion of the curved section 28 the drill string 56 is removed from the well 2 and an intermediate casing 42 may be installed to protect the integrity of the borehole and cemented in place to seal-off any fluid producing zones above the desired subterranean formation 6. The intermediate casing 42 extends from the top surface 4 through the main directional well bore 26 to the desired subterranean formation 6. The need to install intermediate casing 42 will be dictated by the integrity of the overburden strata 12 and in accordance with the design of the curved section 28, the interface zone 36 and the directional sump bore 34.

Drilling of the lateral well bore 32 is initiated following the installation of the intermediate casing 42. The lateral well bore 32 is drilled using the directional drilling assembly 38 in a manner similar to that utilized to complete the curved section 28 of the main directional well bore 26. The lateral well bore 32 is coupled to the interface zone 36 and extends a pre-designed length along a projected azimuth from the interface zone 36 in a substantially horizontal plane parallel to and within the approximate limits of the desired subterranean formation bottom 20 and the desired subterranean formation top 22 of the desired subterranean formation 6. Geologic formations generally do not lie in a true horizontal plane and do not maintain a uniform thickness over the planned drilling area. Formations such as coal seams, carbonaceous shales, silicious shales, and other strata containing hydrocarbons commonly dip, pitch, roll and vary in thickness over relatively short distances. In order to maintain the lateral well bore 32 predominantly within the top and bottom limits 20 and 22 of the desired subterranean formation 6 a real-time oriented gamma ray (OGR) device may be used. An OGR combined with conventional or electromagnetic (EM) MWD systems can provide highly accurate geo-steering within the desired subterranean formation 6.

Referring to FIG. 2, once the lateral well bore 32 has been drilled to its designed length, the drilling tools 38 may be retracted from the well 2 and refitted to begin drilling the directional sump bore 34. A different style bit may be required to drill the directional sump bore 34 and depends on the geophysical properties of the substrata 46. The drilling tools 38 such as the downhole motor, bit and MWD assembly are re-inserted through the intermediate casing 42 to the interface zone 36 to initiate drilling of the directional sump bore 34. The directional sump bore 34 is drilled from the interface zone 36 at a low angle declined from horizontal through the subterranean formation 6 into the substrata 46 to a point below the interface zone 52 and below the desired subterranean formation 6. Drilling continues at a pre-designed angle until the designed length of the directional sump bore 34 has been achieved. The preferred angle between the longitudinal axis of the directional sump bore 34 and a horizontal plane should range between ten degrees and twenty degrees. The acute angle formed between a horizontal plane and the sump bore may exceed twenty degrees as required to ensure functionality of the sump bore and fluid removal system.

Figure 3:
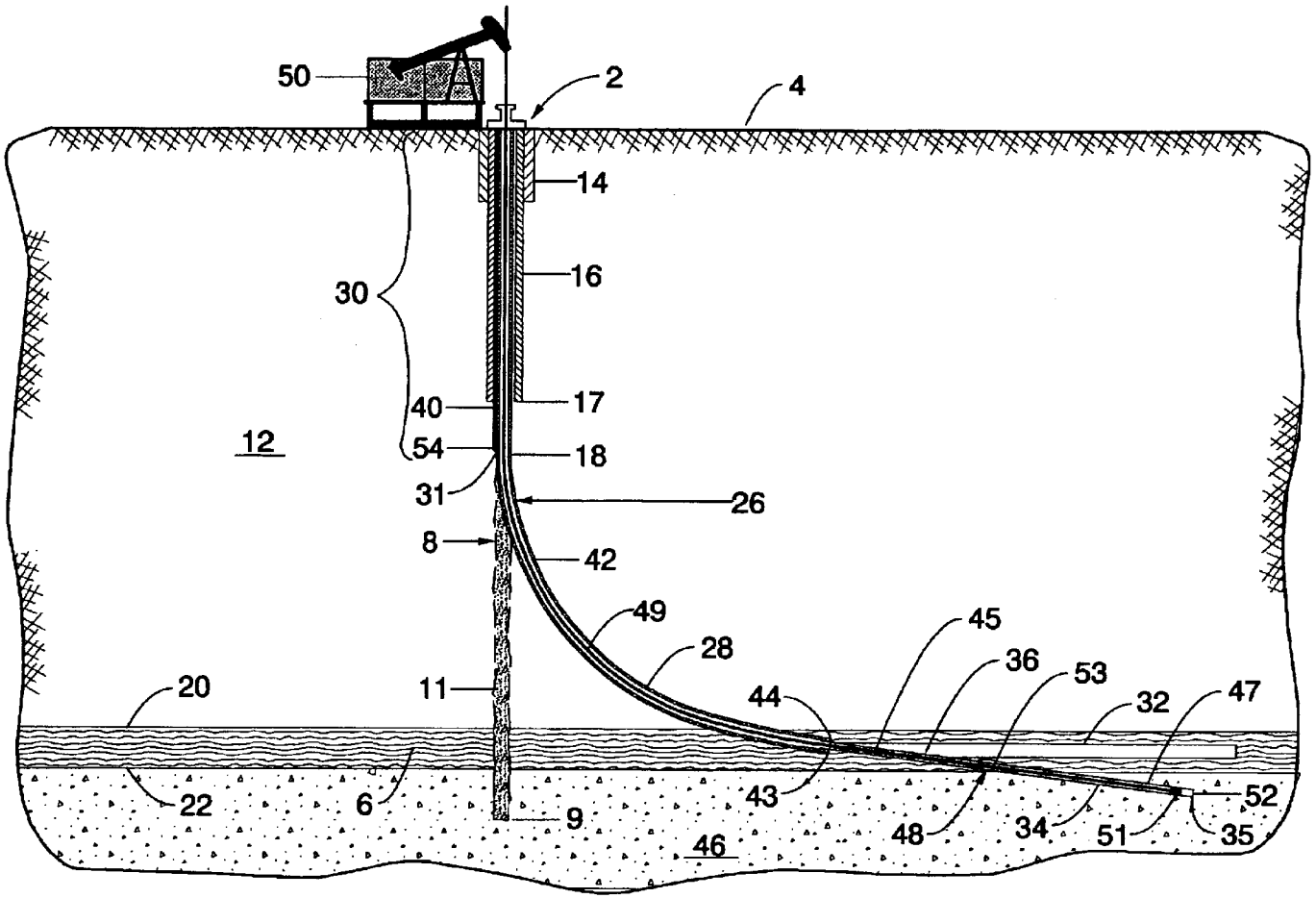
FIG. 3 illustrates a cross-sectional view of the completed well showing the main directional well bore, a lateral well bore and a directional sump bore fitted with a slotted production liner and a pumping apparatus.
Figure 3A:
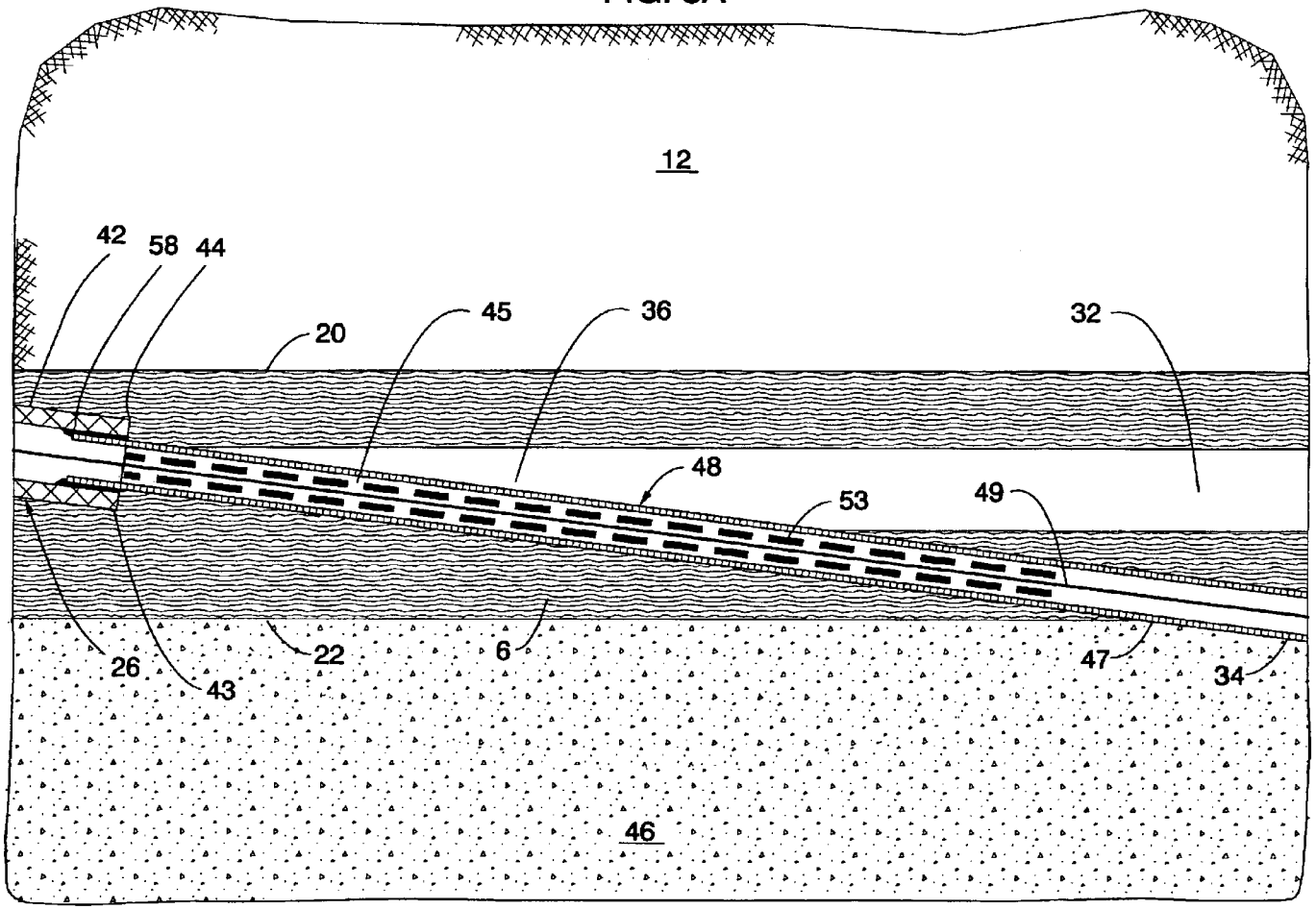
FIG. 3A is an enlarged cross-sectional view of FIG. 3 further illustrating the bottom end of the intermediate casing, interface zone, lateral well bore and directional sump bore fitted with a slotted production liner.

Referring to FIG. 3 after the directional sump bore 34 has been completed the drill string 56 (shown in FIG. 2) and directional drilling tools 38 (shown in FIG. 2) are removed from the well 2. A slotted production liner 48 is lowered through the intermediate casing 42 and secured with a hanging assembly 58 at the intermediate casing bottom 43 as illustrated in FIG. 3A. The slotted production liner 48 has an upper slotted section 45 and lower solid section 47. The upper slotted section 45 has two joints approximately forty feet in total length that contain perforations 53 along the liner's longitudinal axis spaced at intervals around its circumference. The lower solid section 47 does not have perforations. The slotted production liner 48 is positioned so that the upper slotted section 45 is within the interface zone 36 and the lower solid section 47 extends to a point below the interface zone 52 near the directional sump bore bottom 35. The slotted production liner 48 allows fluids from the lateral well bore 32 to pass into the directional sump bore 34 or out through the intermediate casing 42 to the top surface 4. Fluids that flow into the directional sump bore 34 from the lateral well bore 32 are pumped to the top surface 4 through the pump tubing 49 that is connected to a conventional pumping apparatus 50. The suction end (pump inlet) 51 of the pumping apparatus 50 is situated below the interface zone 36 inside the lower solid section 47 of the slotted production liner 48.

FIG. 3 further illustrates a completed well 2 fitted with a pumping apparatus 50 that will operate until the water volume within the desired subterranean formation 6 is sufficiently lowered to permit the flow of hydrocarbons into the slotted production liner 48 and out to the top surface 4 through the annulus of the pump tubing 49 and the intermediate casing 42 or out through the pump tubing 49.

Figure 4:
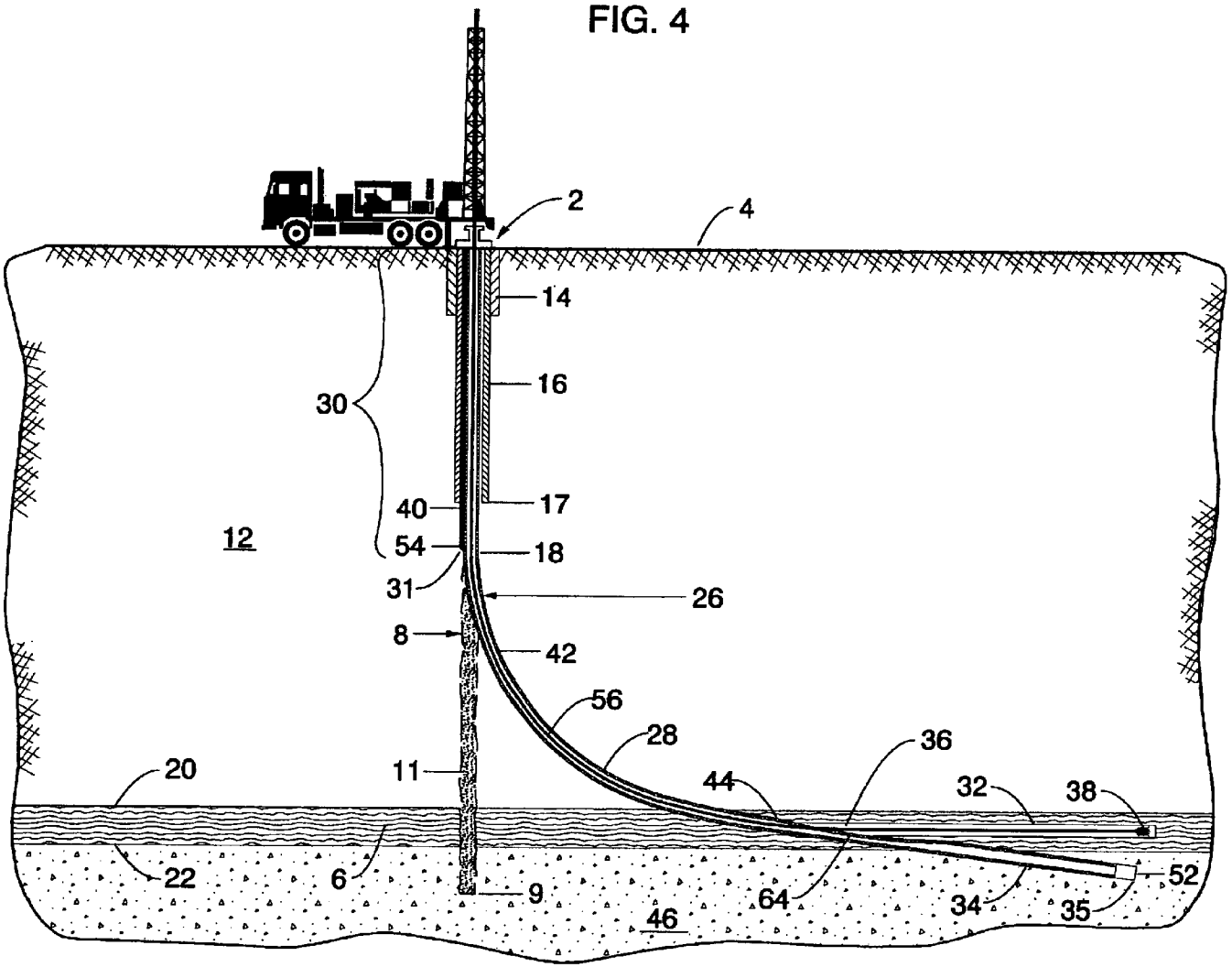
FIG. 4 illustrates a cross-sectional view of a well showing the main directional well bore, interface zone, lateral well bore and sump bore. The well is lined with an intermediate casing from the surface through the sump bore and includes a pre-milled window section positioned in the interface zone that is part of the intermediate casing.
Figure 4A:
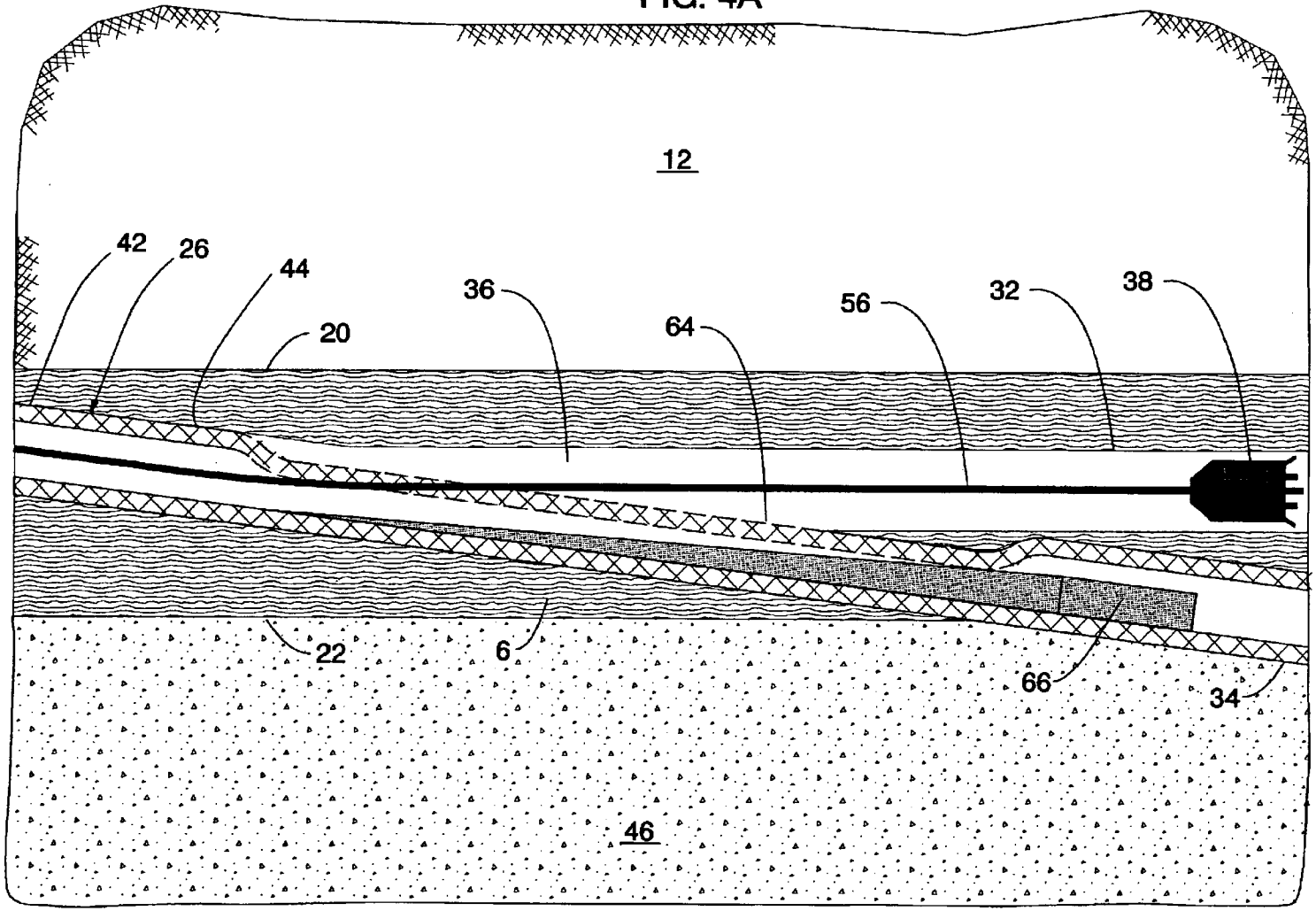
FIG. 4A is an enlarged cross-sectional view of FIG. 4 illustrating the interface zone, lateral well bore and sump bore utilizing an intermediate casing with a window section and a whipstock. The enlarged view shows the position of the window section and whipstock relative to the interface zone, lateral well bore and sump bore.

FIG. 4 and FIG. 4A illustrate a second embodiment that incorporates a window 64 in the bottom section of the intermediate casing 42. In this application, the preferred method is to drill the directional sump bore 34 to its designed length before drilling the lateral well bore 32. Once the directional sump bore 34 has been completed the intermediate casing 42 is installed through the main directional well bore 26, through the interface zone 36 and into the sump bore 34. The window section 64 of the intermediate casing 42 is the same diameter as the intermediate casing 42. The window section 64 of the intermediate casing 42 is situated within the interface zone 36 at a pre-designed distance from the bottom of the sump bore 34 to ensure the window 64 (opening) is aligned with the designed starting point of the planned lateral well bore 32. The balance of the intermediate casing below the window section 64 consists of standard casing that extends to a point below the interface zone 52 near the bottom of the directional sump bore 34. Once the intermediate casing 42 and the connected window section 64 have been fully inserted through the main directional well bore 26 and into the sump bore 34, the intermediate casing 42 may need to be rotated to orient and align the window 64 with the planned lateral well bore 32. The method and tools necessary to accurately orient the window section 64 such that the window 64 is facing the designed starting point of the lateral well bore 32 are well known to those skilled in the art.

After the window section 64 has been properly aligned with the planned lateral well bore 32 the intermediate casing 42 is cemented and the planned lateral well bore 32 is prepared for drilling. The drill string is fitted with specialized tools (such as a fishing spear, oil jar, and bumper jar) and inserted through the intermediate casing 42 to engage an inner sleeve (not shown) of the pre-milled window and remove the inner sleeve from the well 2. The inner sleeve provides a temporary seal behind the pre-milled window section 64 to prevent any loose material or cement from entering the intermediate casing. A whipstock 66 (not shown in FIG. 4), packer (not shown) and running assembly (not shown) are then inserted into the intermediate casing 42 and lowered to a pre-designed point within the window section 64. The whipstock 66 is engaged in the orientation sub and the packer is set securing the whipstock 66 in the intermediate casing 42. The running assembly is removed from the well 2 and the directional drilling tools 38 are re-inserted in the main directional well bore 26 and lowered to the window section 64. Fluid circulation is initiated and drilling of the lateral well bore 32 begins. The whipstock 66 has a wedge shaped end that provides a means of deflecting the drilling tools 38 through the window section 64 and guides the drill bit into the initial section of the lateral well bore 32. The window section 64 of the intermediate casing 42 is pre-milled (cut-out) along the longitudinal axis of the casing and has a length and width designed to accommodate the directional drilling tools 38 required to drill the lateral well bore 32. The lateral well bore 32 is drilled to a pre-designed length along a projected azimuth using the directional drilling tools 38. Once the lateral well bore 32 is complete, the drilling tools 38 are removed from the well 2 and retrieving tools are attached to the drill string and lowered through the intermediate casing 42 to grasp the whipstock 66 and packer and remove them from the well 2. The sump bore 34 is now open to receive fluids from the lateral well bore 32 that pass through the window section 64 into the sump bore 34 or out to the top surface 4 through the intermediate casing 42. The well 2 is fitted with an appropriate pumping apparatus 50 and pump tubing 49 is inserted through the main directional well bore 26 into the sump bore 34 to provide a means of removing fluids from the sump bore 34 to the top surface 4.

To facilitate removal of drill cuttings and drilling fluids and to reduce the potential formation-damaging effects of hydrostatic pressure compressed air may be introduced into the system during the drilling process. Drilling fluids are commonly used during the drilling process. The fluids are pumped from the top surface 4 down the drill string 56 and exit near the bit assembly of the drilling tools 38. The fluids perform several key functions including providing lubrication for the bit, propelling the downhole drive motor used in the directional drilling phase and serve as a medium to flush the drill cuttings from the bit area and out to the top surface 4 through the annulus of the drill string 56 and the intermediate casing 42. The fluids contained in the drill string 56 and intermediate casing 42 create a column of liquid that exerts hydrostatic pressure on the desired subterranean formation 6 in the area of the interface zone 36 and over the length of the lateral well bore 32. When the hydrostatic pressure exerted by the column of liquid exceeds the breakdown pressure of the desired subterranean formation 6 damage to the formation may occur inhibiting the recovery of hydrocarbons. This condition is commonly referred to as an "overbalanced" drilling environment and can be prevented by introducing a sufficient volume of compressed air (or other low density fluids, foam or gases) into the drilling process.

Figure 2A:
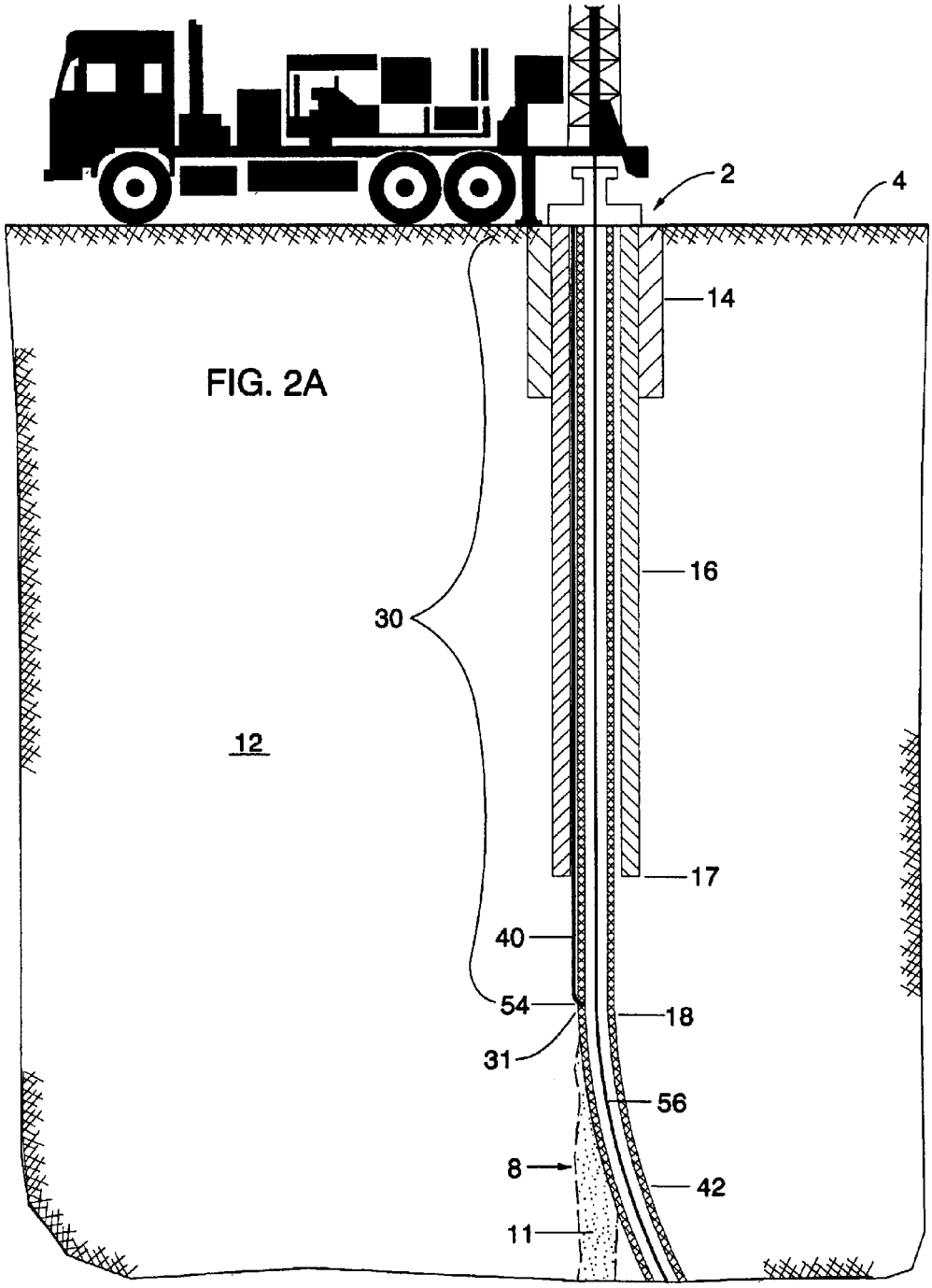
FIG. 2A is an enlarged cross-sectional view of FIG. 2 showing the substantially vertical section of the well with the installed parasite tube.

Several methods exist for supplying compressed air (or other low density fluids, foam or gases) into a well 2 and are well known to those skilled in the art. The present method incorporates a parasite tube 40, illustrated in FIG. 2A, that is attached to the outside wall of the intermediate casing 42 and enters the casing through an elbow joint at a point of intersection 54 near the vertical section bottom 31 of the intermediate casing 42. The compressed air is pumped down the parasite tube 40 into the interior of the intermediate casing 42 where the air co-mingles with the drill cuttings and drilling fluids and is circulated to the top surface 4 through the intermediate casing 42. The density of the air-entrained fluid is less than the inherent fluid density and reduces the hydrostatic pressure exerted on the desired subterranean formation 6 by the fluid column Reducing the hydrostatic pressure below the natural pressure in the desired subterranean formation 6 creates an "underbalanced" drilling environment. An underbalanced condition prevents damage to the formation by limiting the migration of drilling fluids and/or drill cuttings and fine particles entrained in the fluids from entering the natural fractures and pores of the desired subterranean formation 6. This procedure is particularly critical in low-pressure reservoirs that are susceptible to formation damage from overbalanced drilling conditions. It is important in these type of low pressure formations or reservoirs to ensure an "underbalanced" drilling environment is maintained during the drilling of the interface zone 36, lateral well bore 32 and the directional sump bore 34.

Additional methods and techniques of introducing compressed air (or other low density fluids, foams or gases) into the drilling process are well known to those skilled in the art. These alternate methods or techniques may be incorporated in the present drilling process to create an underbalanced drilling environment in lieu of using a parasite tube 40. Alternate methods may include utilizing a smaller diameter casing inserted inside the intermediate casing 42 from the top surface 4 to the interface zone 36. Compressed air (or other low density fluids, foams or gases) can be supplied through the annulus of the smaller diameter casing and the intermediate casing 42 or can be introduced into the fluids entering the drill string 56 in order to reduce the effects of hydrostatic pressure on the desired subterranean formation 6. Air mist (a combination of compressed air and water) and various chemical foams may be used as the primary drilling fluid. Air mist and foams are low density fluids that can maintain an underbalanced drilling environment throughout the drilling process. Each type of drilling fluid has its own advantages and disadvantages and must be designed by those skilled in the art for the specific geologic setting and drilling application being undertaken.

The produced hydrocarbons are captured at the top surface 4 and depending on the inherent quality may be directed to a pipeline gathering system for commercial sale or may require treatment prior to sale.

Figure 5:
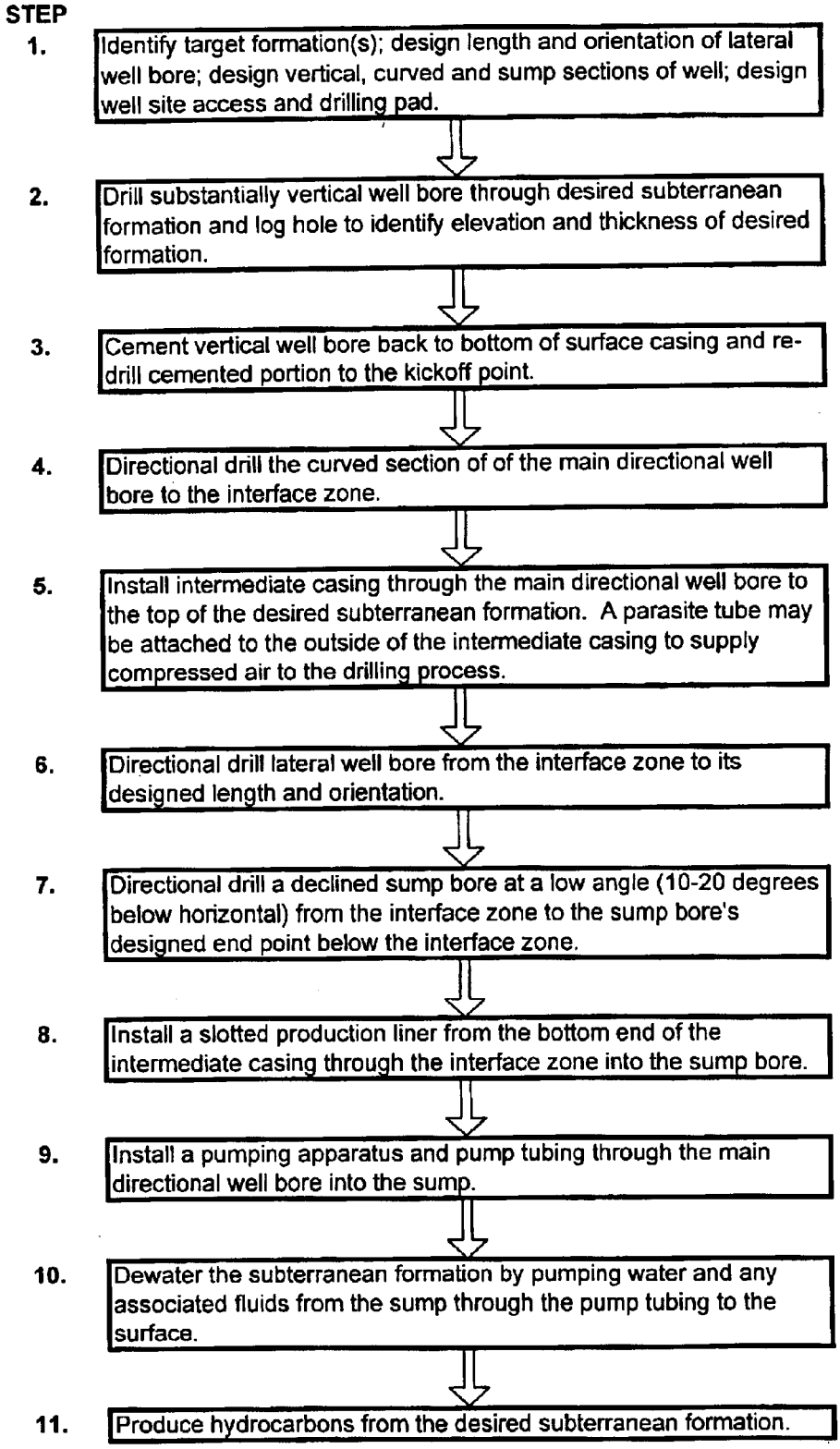
FIG. 5 represents a flow diagram outlining the steps required to construct a well using a slotted production liner to remove fluids and hydrocarbons from a desired subterranean formation.
Figure 6:
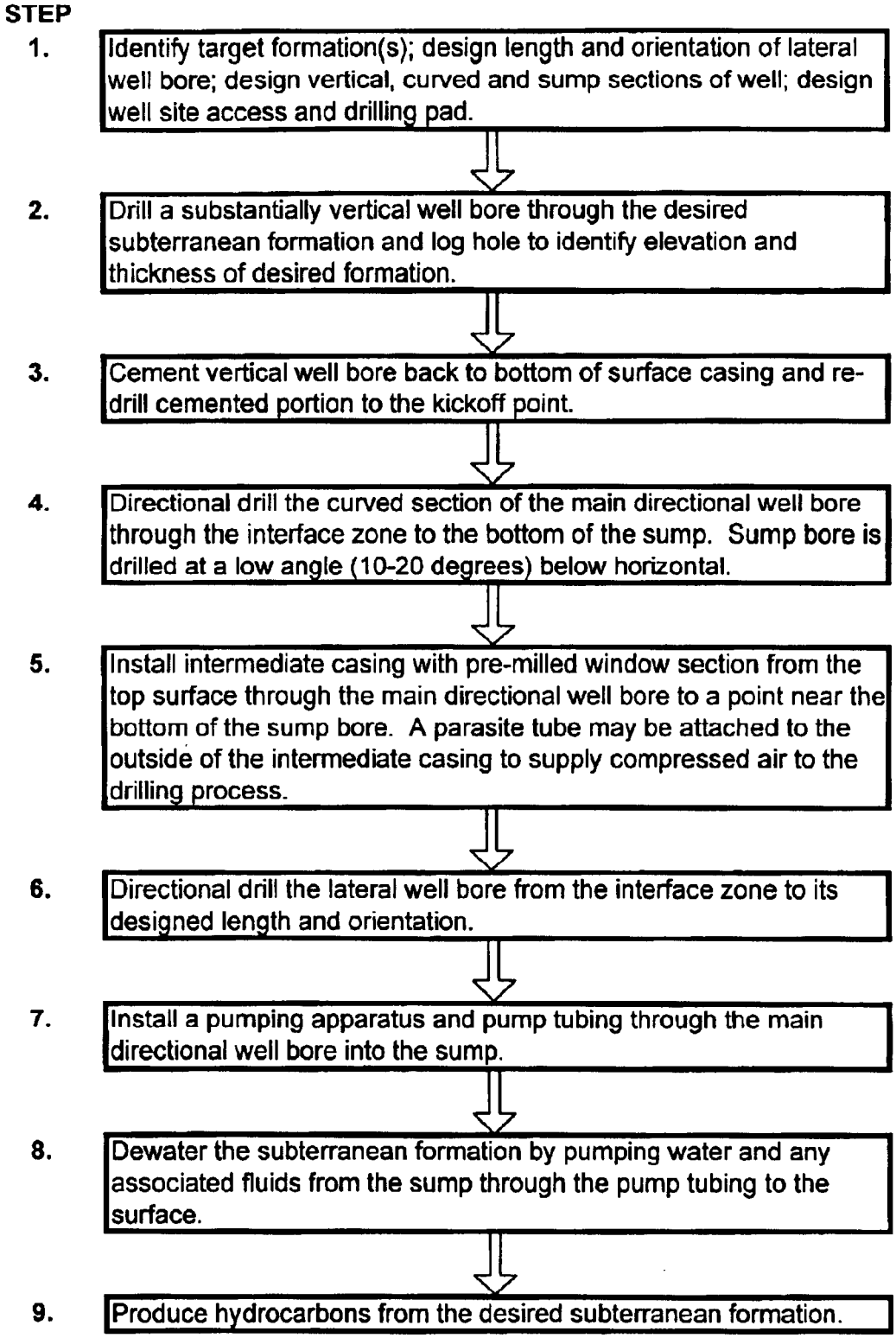
FIG. 6 represents a flow diagram outlining the steps required to construct a well using a window in the intermediate casing to remove fluids and hydrocarbons from a desired subterranean formation.

FIGS. 5 and 6 are flow chart descriptions of both embodiments.

Example of data that could be used to drill a well:

Proposed Casing Program:

A. Conductor Casing: Drill to approximately 30'—Set 1 joint of 16" casing and cement if required.

B. Surface Casing: Drill 15¾" hole to approximately 100'. Set 48#—13⅜" OD casing with guide shoe on bottom. A cement basket will be installed on second joint from surface. Cement will be circulated back to surface. If this is not achieved, the hole will be filled from the surface. Drill 12¼" hole to approximately 228' and/or below all fresh water zones. Set 32.75#—10¾" OD casing with guide shoe on bottom. A cement basket will be installed on second joint from surface. Centralizer will be installed on every other joint down hole. Cement will be circulated back to surface. If this is not achieved, the hole will be filled from surface.

C. Production Casing: Drill 9⅞" hole to TVD of 728' (MD approximately 985'). Run 707' of 26#—7" L-80 with flush joint threaded casing and 278' of 19#—7" casing to approximately TVD of 728' (MD approximately 985'). Install centralizers on bottom joint of 19# and proceed up the hole with centralizers on every third joint. Permanently cement casing back to surface with Class A Standard Cement.

After completion of the horizontal drilling, install 13.6# 4½" N-80 with flush joint threaded casing from the bottom of the previously installed 7" at a MD of approximately 985' to an approximate TVD of 769'. This casing will be slotted through the coal seam and will extend approximately 40' below the coal seam into the water collection sump. This casing will be installed with a mechanical liner hanger/packer at the bottom of the previously installed 7" casing. The casing will not be cemented.

Anticipated Completion:

After installation of the surface casing to 228' depth, a 9⅞" hole will be drilled vertically from 228' depth to the KOP at 278' depth. A curve of approximate radius of 450 will begin at the KOP at 278' depth and will land in the coal seam at a TVD of 728'. 7" casing will be install from 728' TVD back to the surface and cemented. The horizontal hole (6.125" diameter) will continue in the Seam for an approximate distance of 5,000' (MD of approximately 5,535'). After completion of the main horizontal hole, two legs (leg 1 @ length of 1,500' and leg 2 @ length of 2,000') will be drilled off of the main hole at a measured depth of 3,035'. Upon completion all horizontal holes, a water collection sump will be drilled near the bottom of the curved section that will extend approximately 250' in length to an approximate depth of 40' below the Seam. Additional production casing will be installed from the bottom of the 7" production casing at TVD 728' through the Seam to an approximate depth of 769'. This casing will be slotted through the Seam.

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A method for making a well for removing fluid from a desired subterranean formation comprising:

(a) providing an interface zone;

(b) providing a main directional well bore that extends from a top surface at ground level into the desired subterranean formation and is coupled to the interface zone;

(c) providing a lateral well bore coupled to the interface zone;

(d) providing a directional sump bore that is coupled to the interface zone, the directional sump bore extends from the interface zone to a point below the interface zone; and (e) providing means for moving fluid from the directional sump bore from the point below the interface zone through the main directional well bore to the top surface.

2. A method as recited in claim 1 wherein the interface zone is within the subterranean formation.

3. A method as recited in claim 1 wherein the main directional well bore as an intermediate casing.

4. A method as recited in claim 3 including inserting a slotted production liner that has a diameter that is smaller than a diameter of the intermediate casing an has a hanging assembly at a top end of the slotted production liner so that the slotted production liner can be inserted into the intermediate casing and is secured to the bottom of the interme-

| Casing Depths and Specifications: | | | Formation Depth Prediction: |
|---|---|---|---|
| | Interval | Spec. | Anticipated Coal Seams: Surface = 1046' |
| Conductor: | (0–30') | 16" 55# | Seam 1 382' |
| Surface Casing: | (0–100') | 13–3/8" 48# | Seam 2 638' |
| | (0–228') | 10–3/4" 32.75# | |
| Production Casing: | (0–278') | 7" 19# | Seam 3 728' |
| | (278'–728') | 7" 26# | |
| | (728'–769') | 4–1/2" 13.6# | |

diate casing by the hanging assembly and the slotted production liner extends into the directional sump bore.

5. A method as recited in claim 1 wherein the well has an intermediate casting that extends from the top surface through the main directional well bore into the directional sump bore.

6. A method as recited in claim 5 wherein the intermediate casing has a dow located in the interface zone.

7. A method for making a well for removing fluid from a desired subterranean formation comprising:

(a) providing a main directional well bore that extends from a top surface at ground level into the desired subterranean formation;

(b) inserting an intermediate casing having an attached external parasite tube that extends from the top surface to a point of intersection with the intermediate casing;

(c) inserting air pressure down the parasite tube;

(d) inserting drilling fluid down a drill string within the intermediate casing to create a hydrostatic pressure less than a desired subterranean zone breakdown pressure which provides an underbalanced drilling environment and facilitates the removal of cuttings and drilling fluid to be circulated to the top surface a ground level through the intermediate casing;

(e) drilling an interface zone that is coupled to the main directional well using the underbalanced drilling environment;

(f) drilling a lateral well bore that is coupled to the interface zone using the underbalanced drilling environment;

(g) drilling a directional sump bore that is coupled to the interface zone using the underbalanced drilling environment, the directional sump bore extends from the interface zone to a point below the interface zone; and (h) providing means for moving fluid from the directional sump bore from the point below the interface zone through the main directional well bore to the top surface.

8. The method as recited in claim 7 wherein the lateral well bore is drilled nor to drilling the directional sump bore.

9. A method as recited in claim 7 including inserting a slotted production liner that has a diameter that is smaller than a diameter of the intermediate casing and has a banging assembly at a top end of the slotted production liner so that the slotted production liner can be inserted into the intermediate casing and is secured to the bottom of the intermediate casing by the hanging assembly and the slotted production liner extends into the directional sump bore.

10. A method as recited in claim 7 wherein the intermediate casing extends from the top surface into the directional sump bore.

11. A method as recited in claim 10 wherein the intermediate casing has a window located in the interface zone.

12. A method as recited in claim 7 wherein the subterranean formation is a coal seam.

13. The method as recited in claim 12 wherein the lateral well bore is drill prior to drilling the directional sump bore.

14. A method as recited in claim 12 including inserting a slotted production liner that has a diameter that is smaller than a diameter of the intermediate casing an has a hanging assembly at a top end of the slotted production liner so that the slotted production liner can be inserted into the intermediate casing and is secured to the bottom of the intermediate casing by the hanging assembly and the slotted production liner extends into the directional sump bore.

15. A method as recited in claim 12 wherein the intermediate casing extend from the top surface to the directional sump bore.

16. A method as recited in claim 15 wherein the intermediate casing has a dow located in the interface zone.

* * * * *